United States Patent [19]

Wilson et al.

[11] Patent Number: 4,469,151

[45] Date of Patent: Sep. 4, 1984

[54] FLUID LAYERING DEVICE

[76] Inventors: Billie J. Wilson; Jack C. Wilson, both of 3620 NW. 178th Ave., Portland, Oreg. 97229

[21] Appl. No.: 385,848

[22] Filed: Jun. 7, 1982

[51] Int. Cl.[3] ..... B65B 3/04

[52] U.S. Cl. ..... 141/286; 141/383; 141/386; 422/100; 422/102; 422/103; 239/567; 118/408; 134/166 R

[58] Field of Search ..... 422/100, 101, 103, 99, 422/102; 141/286, 383–386; 118/408; 134/166 R; 239/542, 567

[56] References Cited

U.S. PATENT DOCUMENTS

| | | | |
|---|---|---|---|
| 1,014,935 | 1/1912 | Barry | 141/286 |
| 1,155,848 | 10/1915 | Tyrrell . | |
| 1,262,274 | 4/1918 | Shelor | 141/286 |
| 1,290,656 | 1/1919 | Price | 141/286 |
| 1,306,890 | 6/1919 | Godfrey | 141/286 |
| 1,456,854 | 5/1923 | McGhee et al. | 141/286 |
| 1,554,805 | 9/1925 | Fullips | 141/286 |
| 1,626,839 | 5/1927 | Kallmeyer . | |
| 1,779,739 | 10/1930 | Kantor et al. | 141/286 |
| 2,132,424 | 10/1938 | Le Frank | 141/286 |
| 2,172,010 | 9/1939 | Kerr | 141/286 |
| 2,350,721 | 6/1944 | Brown . | |
| 2,356,142 | 8/1944 | Ayars | 141/286 |
| 2,639,851 | 5/1953 | Duncan | 141/286 |
| 2,740,571 | 4/1956 | Busto | 141/286 |
| 2,805,889 | 9/1957 | Terry . | |
| 3,185,189 | 5/1965 | Reid | 141/286 |
| 3,256,916 | 6/1966 | Silletti | 141/286 |
| 4,126,164 | 11/1978 | Magnifico | 141/286 |
| 4,150,089 | 4/1979 | Linet | 422/103 |
| 4,298,167 | 11/1981 | Stahl et al. . | |
| 4,301,798 | 11/1981 | Anderson . | |
| 4,337,806 | 7/1982 | Cirella | 141/286 |

FOREIGN PATENT DOCUMENTS 2349940 4/1975 Fed. Rep. of Germany .

*Primary Examiner*—Steven L. Weinstein

*Attorney, Agent, or Firm*—Kolisch, Hartwell, Dickinson & Anderson

[57] ABSTRACT

A fluid layering device for use with a syringe to facilitate layering a liquid from the syringe onto a denser liquid contained in an open-top centrifuge tube. A fitting in the device is releasably attachable to the syringe for receiving liquid therefrom. An elongate nozzle carried on the fitting has a pair of opposed end faces, and a pair of flow-constricting bores communicating associated nozzle end faces with liquid received in the fitting. An annular step formed on the fitting is engageable by friction fit with the tube's upper open end to hold the nozzle at an axially aligned position within the tube. At this position, each of the nozzle end faces confronts, and is spaced from, an inner wall portion in the tube by a clearance which is adapted to produce, with liquid being forced from the syringe through the associated bore in the nozzle, a controlled-flow ribbon of liquid down the wall of the tube onto the upper surface of the denser liquid in the tube.

7 Claims, 4 Drawing Figures

FLUID LAYERING DEVICE

BACKGROUND AND SUMMARY

The present invention relates to a device for use in layering liquid onto the upper surface of a denser liquid contained in an open-top centrifuge tube.

Separation of cellular or subcellular components by centrifugation through a liquid separation medium is a widely used technique in medical laboratories. One important example of this technique is the separation of blood cell components by low-speed centrifugation of a blood sample layered in a centrifuge tube over a separation medium which typically includes an erythrocyte aggregating agent. This technique, which permits separation of a mononuclear cell fraction containing blood lymphocytes from other blood cell components, is used in such areas as histocompatability testing, invitro cell-mediated immunity assays, and other assay procedures requiring relatively pure lymphocyte preparations.

Heretofore, a variety of techniques have been devised for layering a blood sample over a separation medium in practicing the above blood cell separation method. In one technique, a volume of separation medium is placed in a tube, and a blood sample is layered carefully over the medium using a capillary pipette or the like. This procedure is relatively time consuming, and requires some skill in preparing tube samples having sharp blood/separation medium interfaces.

In another known blood-layering technique, a blood sample is introduced into a centrifuge tube and then underlayered with the separation medium. This technique, while substantially faster than the overlayering technique just described, results in considerable mixing at the interface between the blood sample and separation medium. Consequently, the yield of cells, particularly in the mononuclear cell fraction, tends to be quite variable.

A more recent blood layering technique employs a syringe equipped with a minimum volume extension set (Cutter Laboratories, Berkeley, Calif.), as described in Wilson, B. J., and Kocvara, H., "A simple and rapid method for layering blood on Ficoll-Paque gradients." *J. Immuno. Meth.*, September 1979, 67–68. An advantage of this technique is that a relatively large-volume blood sample can be dispensed from the loaded syringe, unlike the capillary pipette which must be refilled continually during a layering operation. The syringe technique requires special tube handling to prepare a sharp-interface tube sample.

A general object of the invention is to provide a layering device which substantially overcomes above-mentioned problems associated with known sample-layering techniques.

A more specific object of the invention is to provide such a device which permits sharp-interface sample layering over a separation medium in a centrifuge tube.

Still another object of the invention is to provide such a device which is readily adapted for use with a liquid-dispensing manifold for layering a liquid sample simultaneously in a plurality of tubes.

Providing a device which is inexpensive in manufacture and can be supplied as a sterilized, disposable item is yet another object of the present invention.

The device of the present invention is constructed for use with a liquid dispenser, to facilitate layering a liquid from the dispenser onto a denser liquid contained in an open-top tube. A fitting in the device is releasably attachable to the dispenser for receiving liquid therefrom. A nozzle carried on the fitting has an outer opening and a flow-constricting bore communicating the opening with liquid received in the fitting. Positioning structure in the device is adapted to hold the nozzle at an operative position with respect to the centrifuge tube. At this position, the nozzle opening confronts, and is spaced from, the tube's inner wall by a defined clearance which is adapted to produce, with liquid being forced from the dispenser through the bore in the nozzle, a controlled-flow ribbon of liquid down the wall of the tube onto the upper surface of the denser liquid in the tube.

These and other objects and features of the present invention will become more fully apparent when the following detailed description of a preferred embodiment of the invention is read in conjunction with the accompanying drawings.

DETAILED DESCRIPTION OF A PREFERRED EMBODIMENT OF THE INVENTION

Figure 1:
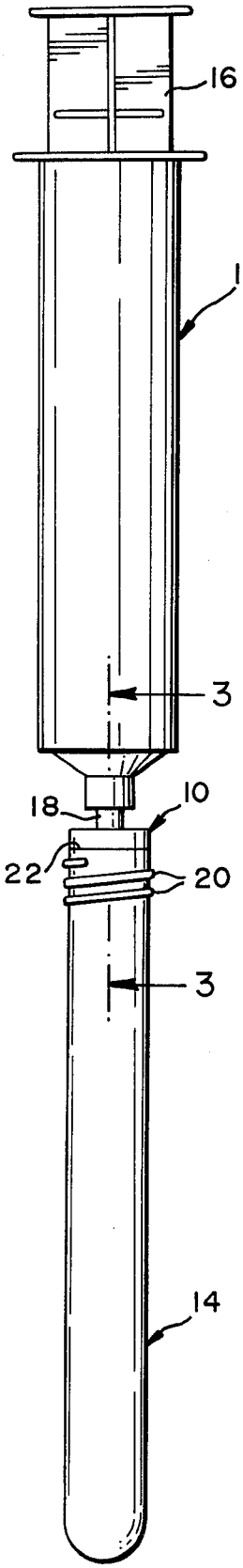
FIG. 1 is a side view of the device of the present invention, shown operatively engaged with a syringe and a centrifuge tube for use in layering a liquid from the syringe onto a denser liquid contained in the tube.
Figure 2:
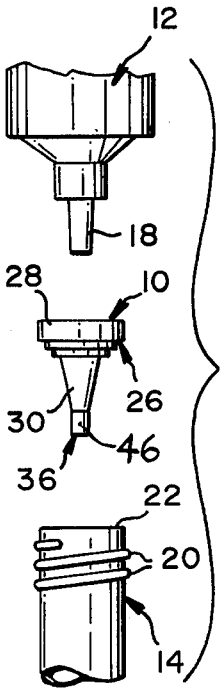
FIG. 2 is a view like FIG. 1 showing the device separated from the syringe and centrifuge tube, which are seen fragmentarily.

A layering device constructed according to the present invention is shown generally at 10 in the figures. The device is constructed for use with a liquid dispenser, such as a syringe 12, to facilitate layering a liquid from the dispenser onto a denser liquid contained in an open-top centrifuge tube, shown at 14. The syringe shown here is a conventional disposable syringe having a 35 ml volume which is displaceable by a plunger 16. A nozzle or tip 18 in the syringe has a generally tapered, or frustoconical shape, seen best in FIG. 3. While one type of syringe has been described herein, it will be understood that other dispensers constructed to dispense a liquid under pressure may be used in conjunction with device 10.

Tube 14 preferrably is a disposable standard-size culture tube constructed to withstand low-speed centrifugation. The culture tube typically includes a cap (not shown) engagable with threads 20 formed on the tube, for capping the tube's upper open end 22. Tubes, such as tube 14, are supplied in a standardized size having a well defined inner-diameter dimension. One particular type of tube which the present invention may be used with is a No. 3033 culture tube, manufactured by Falcon Plastics, 1950 Williams, Oxnard, Calif. 93030.

Looking now at details of device 10, a fitting 26 in the device (FIG. 3) is composed of an annular cap portion 28 and a neck portion 30 formed with, and extending axially from, the inner side of the cap portion. Formed in the fitting is an elongate, axially extending channel or passage 32. The upper part of the channel in FIG. 3 is constructed to receive syringe nozzle 18 by friction fit, to attach the device releasably to the syringe.

Figure 3:
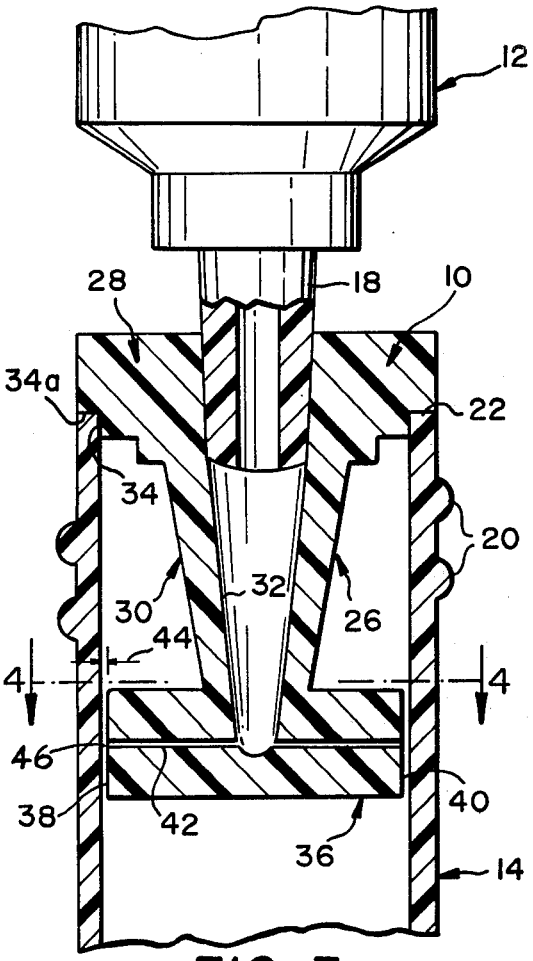
FIG. 3 is an enlarged sectional view taken generally along line 3—3 in FIG. 1.

An annular step 34 formed on the lower surface of the cap portion 28 in FIG. 3 is dimensioned to be received by friction-fit insertion into the tube's upper opening, with the step's outwardly extending annular ledge 34a resting on the tube's upper end rim, as shown. One or more angled grooves (not shown) formed in step 34 allow passage of air into or out of the tube, with the fitting in place on the tube. Step 34, which functions to hold the fitting at an axially aligned position with respect to tube 12, is also referred to herein as positioning means.

Figure 4:
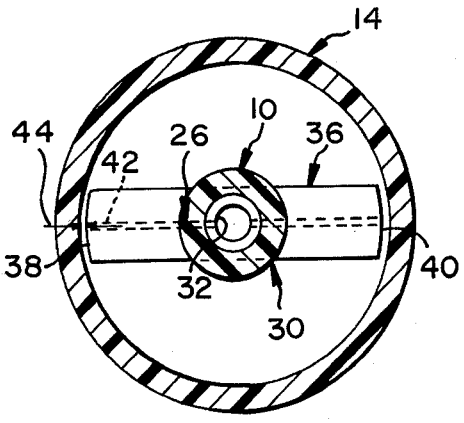
FIG. 4 is a sectional view taken generally along line 4—4 in FIG. 3.

An elongate nozzle 36 in the device is formed with the neck portion, at its lower end in FIG. 3, to extend perpendicular to the axis of channel 32. The nozzle terminates at a pair of opposed end faces 38, 40 which may be curved somewhat, as seen in FIG. 4, to conform to the curvature of the inner wall of tube 12. Each end face communicates with channel 32 through a flow-constricting bore, such as bore 42 communicating end face 38 with the channel. Bore 42, which is representative, has a preferred inner diameter of between about 25 and 40 mils. The bores act to restrict the flow of blood through the device.

With continued reference to FIGS. 3 and 4, it is seen that with device 10 mounted on tube 12, in axial alignment therewith, the end faces in the device are spaced from confronting inner wall portions in the tube by a defined spacing or clearance, such as clearance 44 (FIGS. 3 and 4) between end face 38 and the tube. According to an important feature of the invention, the clearance is adapted to produce, with liquid being forced from the dispenser through the associated bore in the nozzle, a controlled-flow ribbon of liquid down the wall of the tube. Such ribboning allows a sharp interface to be formed in the tube substantially independent of the force applied to the syringe plunger. Clearance 44, and the substantially identical clearance between end face 40 and the confronting portion of the tube 14, has a preferred dimension of between about 5 and 15 mils.

Each end face in the device, such as end face 38, is also referred to herebelow as means defining an opening, such as opening 46, through which fluid is expelled from the device. Here it is noted that the ribboning effect produced by the injection of liquid into the space between the associated end face and the inner wall of the tube depends more on the defined opening-to-tube clearance than on the actual area of the end face. Thus, such ribboning has been observed even where the nozzle end face is as small as the blunt end of a 22 gauge needle.

The speed of blood layering, blood cell fraction yields, and cell viability in layered samples prepared with the device of the present invention were compared with samples prepared by one of two different known blood layering techniques. One of the known techniques employs a 1.5 ml capillary pipette fitted with a large bulb for layering a blood sample over a volume of separation medium in a culture tube. In the second method, a blood sample in a culture tube is underlayered with a separation medium by dispensing the latter from a syringe through a 16 gauge needle whose blunt tip is positioned at the bottom of the tube. The separation medium employed in the experiments is a commercially available sterile solution sold under the name Ficoll-Paque by Pharamacia Fine Chemicals, 800 Centennial Ave., Piscataway, N.J. 08854. The solution includes an erythrocyte aggregating agent and sodium diatriozate.

The time required to layer 12 ml bovine blood, diluted 1:1 with phosphate buffered saline, over 3 ml Ficoll-Paque in a No. 3033 Falcon culture tube was measured using the device of the present invention, and by the capillary pipette overlay method. In the underlay method, the time required to underlay 12 ml of diluted bovine blood with 3 ml Ficoll-Paque was measured. The average time required to complete the layering procedure for each of 10 samples in each method is shown in Table 1. Here it is seen that the average sample layering time, using the device of the present invention (A) and using the underlay method (C), were each less than 50 seconds per sample. By contrast, the average time required to complete an overlay operation using the capillary pipette method (B) was well over 100 seconds per sample. The additional time required in the capillary pipette method is due both to care which must be taken in layering the blood sample, to avoid disturbing the blood/Ficoll-Paque interface, and the time required to refill the micro pipette periodically for each sample.

TABLE 1

| | Average Layering Time (in seconds) | Yield of Mononuclear Cells ($10^5$ cells/ml blood) |
|---|---|---|
| A | 43.1 | 1.9 |
| B | 116.85 | 1.79 |
| C | 49.8 | .76 |

To determine mononuclear cell yield, heparinized blood from normal human subjects diluted with two volumes of phosphate buffered saline was used. In the two overlay techniques—one using the device of the present invention and the other, a capillary pipette—7.5 ml samples of diluted blood were layered over 3 ml Ficoll-Paque in No. 3033 Falcon culture tubes. In the underlay method, 7.5 ml blood samples were placed in the No. 3033 culture tubes and underlayed with 3 ml Ficoll-Paque as described above. Four samples from each of six different human subjects were prepared for each of the three methods. The samples, which were all handled identically after the layering procedure, were centrifuged at 400×G for 40 minutes at 22° C. The lymphocyte-containing layer in each sample (the mononuclear cell fraction) was removed by capillary pipette aspiration and cells were washed by resuspension and recentrifugation in several volumes of phosphate-buffered saline. This method generally follows that described by Boyum, A. "Isolation of mononuclear cells and granulocyles from human blood." *Scand. J. Clin. Lab. Invest.* 21 Suppl. 97 (Paper IV): 77–78, 1968. The washed lymphocyte pellets were resuspended in 0.5 ml phosphate buffered saline and the cells counted in a Coulter counter. The results, expressed as the average number of mononuclear cells $\times 10^2$/ml blood from the six subjects (four samples per subject), are seen in Table 1. These results show that the layering technique using the device of the present invention (A) leads to a mononuclear cell yield which is slightly greater than that achieved with capillary pipette overlayering, (B) and more than twice the yield obtainable with the underlay method (C).

The viability of the mononuclear cell fractions obtained using the three above layering techniques was determined by a conventional trypan blue dye exclusion method, such as that described in Phillips, H. J., "Dye exclusion tests for cell viability." *Tissue Culture: Methods and Applications* ed. by Kruse, P. F., Jr. and Patterson, M. J., Jr.:406–408 (Chapter 3), Academic Press, 1973. There was no observed difference in viability of cells obtained by the three different methods.

The results presented above demonstrate that the device of the invention combines advantages of speed inherent in the underlay method, and good cell yields associated with the capillary pipette method. It was also observed in the above tests that less skill is required in using the device of the invention than in the other two methods employed, and that the cell yields are more consistent, probably reflecting the fact that in the capillary pipette and underlay methods, the amount of interface mixing varies with the amount of care used. While the use and advantages of the device have been illustrated particularly in a blood cell separation technique, the device has obvious applications in a number of laboratory and research techniques which involve gradient layering.

Another important advantage in the present invention is that the person performing the layering operation does not have to monitor the position of the dispenser nozzle in the tube or the rate of liquid flow during layering. As a result, the invention is readily adapted for use with liquid-dispensing manifold which is operable to layer a single sample simultaneously in several centrifuge tubes, where, for example, a large-volume sample is to be fractionated.

The device of the invention can be manufactured inexpensively as a plastic molded article, and can be packaged and sterilized for one-time disposable use.

While a preferred embodiment of the invention has been described herein, it will be appreciated by those skilled in the art the various changes and modifications can be made without departing from the spirit of the invention.

It is claimed and desired to secure by Letters Patent:

1. In combination with a liquid dispenser having a nozzle tip through which liquid is ejected under controlled pressure, an upright, open-top, centrifuge tube, and a fitting establishing a connection between the dispenser and tube for producing a layer of the liquid ejected from the dispenser formed on a denser liquid contained in the centrifuge tube, said fitting comprising a cap portion releasably secured to the top of the centrifuge tube, the cap portion having means centering the cap portion on the top of the tube, said fitting further comprising a nozzle portion held by the fitting below the top of the tube, said nozzle portion having an outer face disposed in spaced confronting relation to the inner wall of the tube and a flow-constricting bore with an outer end opening to said face and extending radially inwardly from said face toward the interior of the tube, said fitting further having a passage opening at the top of the fitting and extending downwardly through the cap portion, the nozzle tip of the dispenser extending downwardly into and snugly seating within said passage, said flow-constricting bore at its inner end connecting with said passage, said outer face of said nozzle being spaced from the inner wall of the tube a clearance distance which produces a controlled-flow ribbon of liquid extending down the wall of the tube from liquid ejected from the dispenser and passing through said passage and through said flow-constricting bore, which ribbon of liquid continues onto the upper surface of the denser liquid within the tube.

2. The combination of claim 1, wherein said means centering the cap portion comprises a recessed annular step formed on said cap, snugly receiving the tube's open top and establishing said fitting in axial alignment with the tube.

3. The combination of claim 1, wherein said clearance distance is between about 5 and 15 mils.

4. The combination of claim 3, wherein said bore has an inner diameter of between about 25 and 40 mils.

5. In combination with a syringe having a nozzle-like tip through which liquid is ejected under controlled pressure with operation of the syringe, an upright, open-top, centrifuge tube, and a fitting establishing a connection between the syringe and tube for producing a layer of the liquid ejected from the syringe on a denser liquid contained within the centrifuge tube, said fitting comprising a cap portion releasably secured to the top of the centrifuge tube which cap portion has means centering the cap portion on the tube, said fitting further comprising a nozzle carried by the fitting below the top of the tube having a pair of opposed outer faces and flow-constricting bores communicating at the outer ends with said faces, said outer faces confronting and being in spaced relation from the inner wall of the tube, said fitting further having a passage opening to the top of the fitting and extending downwardly through the cap portion, said tip of the syringe extending downwardly into and snugly seating in said passage, said flow-constricting bores having inner ends communicating with said passage, said outer faces of said nozzle being spaced from the inner wall of the tube by clearances which produce controlled-flow ribbons of liquid extending down the wall of the tube from liquid ejected from the syringe and passing through said passage and said flow-constricting bores which ribbons of liquid collect as a layer on the denser layer within the tube.

6. The combination of claim 5, wherein the clearances between said outer faces and the tube inner wall are between 5 and 15 mils.

7. The combination of claim 6, wherein each of said bores has a diameter of between 25 and 40 mils.

* * * * *